United States Patent [19]

Woodward

[11] 4,083,051

[45] Apr. 4, 1978

[54] CIRCULARLY-POLARIZED ANTENNA SYSTEM USING TILTED DIPOLES

[75] Inventor: Oakley McDonald Woodward, Princeton, N.J.

[73] Assignee: RCA Corporation, New York, N.Y.

[21] Appl. No.: 702,341

[22] Filed: Jul. 2, 1976

[51] Int. Cl.[2] ..... H01Q 21/26; H01Q 21/00

[52] U.S. Cl. ..... 343/797; 343/798; 343/816

[58] Field of Search ..... 343/796, 797, 798, 807, 343/808, 809, 816

[56] References Cited

U.S. PATENT DOCUMENTS

| | | | |
|---|---|---|---|
| 2,512,137 | 6/1950 | Buchwalter | 343/816 |
| 3,413,644 | 11/1968 | Laub | 343/816 |
| 3,789,417 | 1/1974 | Coleman | 343/816 |

FOREIGN PATENT DOCUMENTS

| | | | |
|---|---|---|---|
| 1,286,311 | 8/1972 | United Kingdom | 343/797 |

OTHER PUBLICATIONS

Teltrac Tracking Systems, Mar. 1963, pp. 1–3, Canoga Electronics Corp., 15330 Oxnard St., Van Nuys, Calif.

*Primary Examiner*—Alfred E. Smith
*Assistant Examiner*—Harry E. Barlow
*Attorney, Agent, or Firm*—Edward J. Norton; Robert L. Troike

[57] ABSTRACT

An omnidirectional circularly-polarized antenna system includes a plurality of dipoles equally spaced in a horizontal circle about a metal support mast. The dipoles are tilted at an angle with respect to the plane of the horizontal circle to excite circularly-polarized waves. The dipoles are fed in phase rotation with adjacent dipoles 90° out of phase.

5 Claims, 10 Drawing Figures

CIRCULARLY-POLARIZED ANTENNA SYSTEM USING TILTED DIPOLES

BACKGROUND OF THE INVENTION

This invention relates to dipole antenna systems and more particularly to a circularly polarized dipole antenna system for FM and TV broadcast. The term circularly polarized as used herein refers to the general class of elliptically polarized antennas with low axial ratio.

Circularly polarized omnidirectional antennas using slanted or tilted dipoles are known. See, for example, an article in RCA Review dated June 1947, Vol. VIII, No. 2 entitled, "Circularly-Polarized Omnidirectional Antenna" by George H. Brown and Oakley M. Woodward, Jr., pp. 259 thru 269. Also, see Lindenblad U.S. Pat. No. 2,217,911. In these arrangements, four slanted dipoles are fed in-phase or in a mode zero (H=O) condition. Although the antenna system as described in this art operates adaquately when the antenna system is mounted at the top of a mast, this arrangement is not practical with support masts where antenna systems are to be stacked one upon the other, because of undesired re-radiation of the support masts. Also, undesired re-radiation occurs from the horizontal support members supporting the radiating dipoles. These re-radiations cause unwanted perturbations in the desired elevation patterns.

P. S. Carter in the Proceedings of the IRE, Dec. 1943, pp. 671 thru 693, entitled, "Antenna Arrays Around Cylinders" discusses arrays of dipoles around spires or other supports. Carter discusses four horizontal or vertical dipoles fed in-phase rotation about the cylinder to achieve an omnidirectional pattern for a horizontally polarized or vertically polarized signal. No solution or discussion is presented with regard to obtaining omnidirectional circularly-polarized radiation.

An article by the present inventor in Mar. 1965 issue of RCA Review entitled, "A Mode Analysis of Quasiisotropic Antennas," pages 42 through 74, discusses obtaining an antenna pattern having rotational symmetry with respect to a reference axis which consists of the superposition of one or more independent decoupled mode types, each of which has a symmetrical radiation pattern. For any given mode, the orientation of the radiators is either axial, tangential, or radial.

SUMMARY OF THE INVENTION

Briefly, a circularly-polarized antenna system for providing an omnidirectional pattern about a support mast is achieved by a plurality of dipole elements equally spaced in a horizontal circle around the vertical support mast with each of the dipoles tilted with respect to the axis of the support mast and the plane of the horizontal circle. The dipoles are fed in a rotating phase where the mode number (the number of 360° phase changes about the circle) is an integer other than zero.

DESCRIPTION OF PREFERRED EMBODIMENTS

Figure 1:
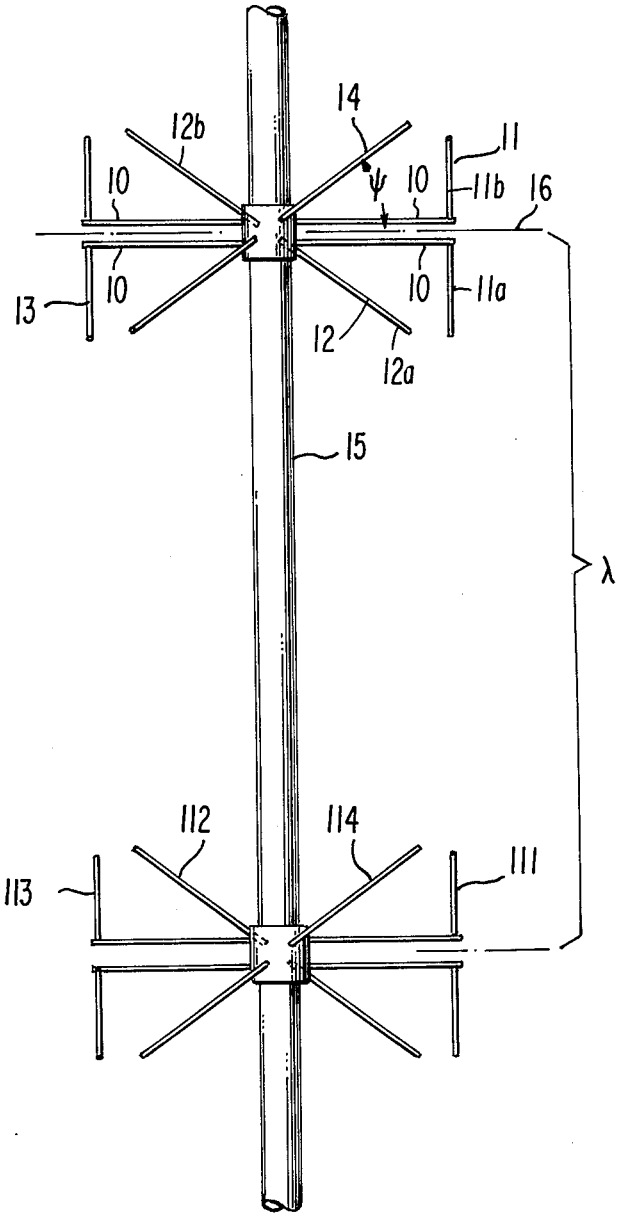
FIG. 1 is a sketch of an antenna system according to one embodiment of the present invention using four tilted dipoles.
Figure 2:
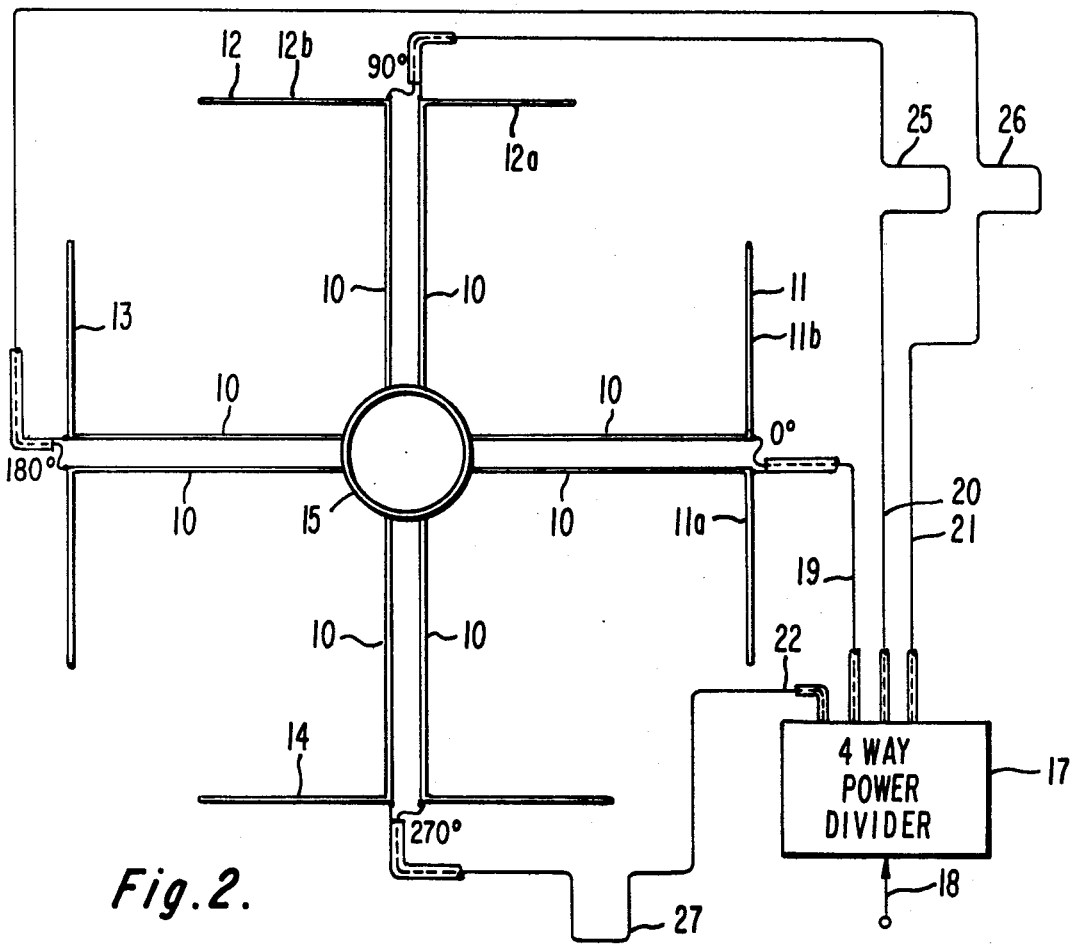
FIG. 2 is a sketch of the top plan view of an antenna system as shown in FIG. 1 illustrating the feed system.

Referring to FIG. 1, four dipoles 11, 12, 13 and 14 are mounted equally spaced in a given horizontal plane 16 around a metal support mast 15. Thus, as represented in FIG. 1, the respective dipoles 11 thru 14 may be secured to a suitable collar or other mount by horizontal support members 10 for positioning the dipoles about the mast 15. The dipoles 11 thru 14 are each tilted a given angle $\psi$ with respect to the horizontal plane 16. The dipoles are spaced the same given distance from the metal mast so that their radiation centers lie on a ring concentric with the mast. The four tilted dipoles, as shown in FIG. 2, are fed with equal power and are fed in relative phase rotation so that dipole 12 adjacent to dipole 11 is fed 90° out of phase (phase quadrature) with respect to dipole 11, dipole 13 is fed 180° out of phase with respect to dipole 11, and dipole 14 is fed 270° out of phase with respect to dipole 11. In this case, the number of 360°-of-phase-change about the circumference of the dipole ring formed by the four dipoles is equal to one (Mode No. H=1). A Mode No. as used herein refers to the integral number of cycles of phase variation through 360° in phase rotation about the center mast 15. This phase variation may be either clockwise or counterclockwise. The power division can be provided by a power divider 17 which equally divides the power from the input lead 18 by four and couples this equal power to coaxial transmission lines 19, 20, 21 and 22. The dipole 11 may be fed by connecting the inner conductor of coaxial line 19 in insulated manner to dipole half **11*b* and the outer conductor to dipole half 11*a*. (For simplicity only a portion of the outer conductors are shown.) The outer conductor of coaxial line 20 is coupled to dipole half 12*a* and the inner conductor is coupled to dipole half 12*b*. Similarly, coaxial line 21 is coupled to dipole 13, and coaxial line 22 is coupled to dipole 14. Coaxial lines 20, 21, 22 include respective sections 25, 26 and 27 which increase the effective length of these lines such that the dipoles are fed in the phases discussed previously. The tilt angle $\psi$ of the dipoles 11 thru 14 relative to the horizontal plane 16** is adjusted so as to produce circularly-polarized radiation. This tilt angle $\psi$ from the horizontal may be, for example, on the order of 36°.

To increase the gain in the horizontal direction, the system as described above is layered or stacked one above the other. Referring to FIG. 1, the system as described above comprising dipoles 11 thru 14 is spaced approximately a wavelength at the operating frequency of the antenna from another identical system of tilted dipoles 111 thru 114 fed in like phase rotation. Additional layers of dipole arrays can be provided for a given application in like fashion.

With the proper choice of the tilt angle for the dipoles and with the dipoles fed in phase rotation as described above, the arrangement of FIGS. 1 and 2 provides a circularly-polarized broadside radiation which is omnidirectional about the mast, with little or no interference being introduced by the mast.

Figure 3:
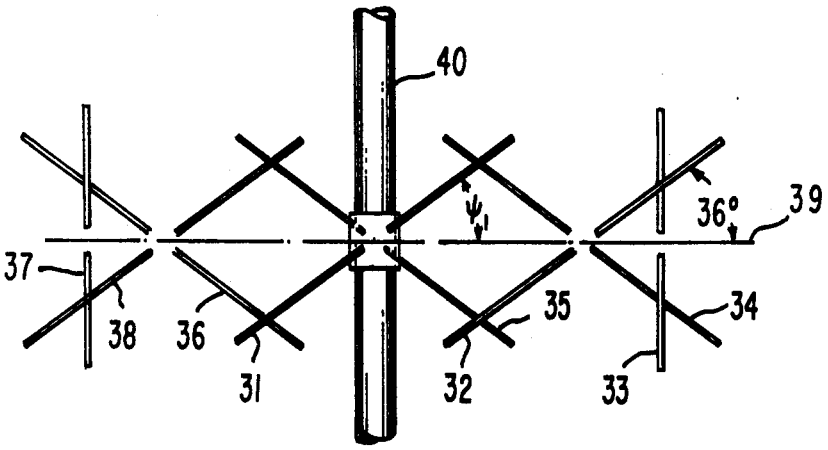
FIG. 3 is a sketch of an antenna system according to another embodiment using eight tilted dipoles.
Figure 4:
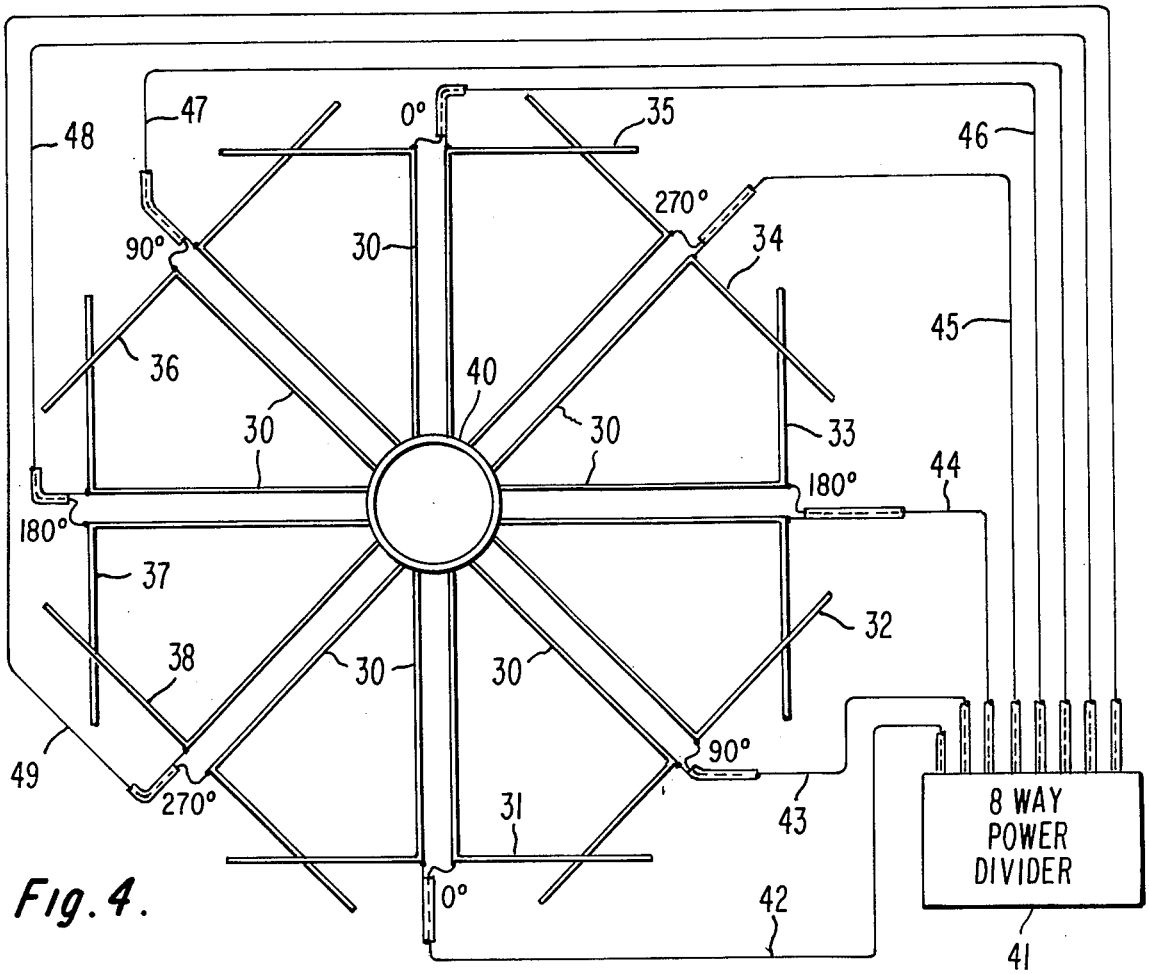
FIG. 4 is a sketch of a top plan view of an antenna system as shown in FIG. 3 illustrating the feed system.
Figure 10:
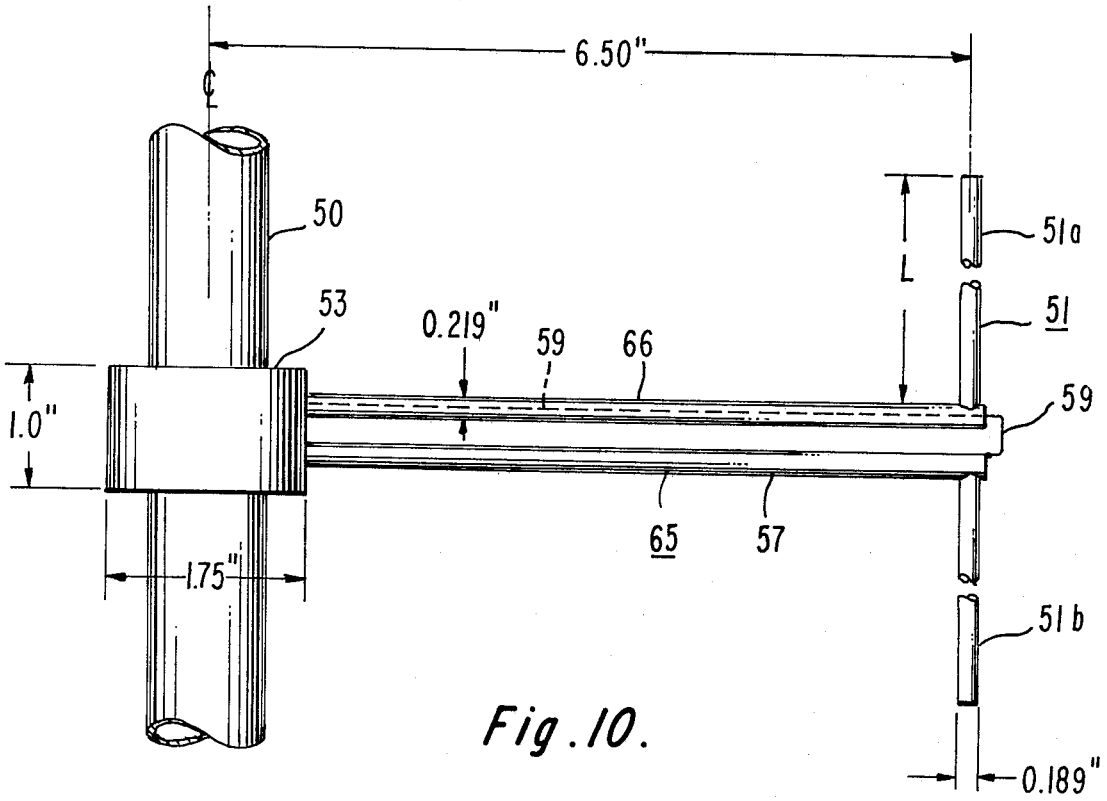
FIG. 10 is a sketch of one dipole and mast of a test model constructed according to one embodiment of the present invention.

Referring to FIGS. 3 and 4, there is illustrated a system in which both mast re-radiation and re-radiation from the horizontal dipole support members is minimized. This system comprises eight equally spaced dipoles 31 thru 38 centered on a horizontal circle concentric with a vertical mast 40 and in a common plane 39 orthogonal to the mast 40. To simplify the drawing, the spacer or support structure for holding the respective dipoles 31 thru 38 from the mast 40 is not shown in FIG. 3 but could be as represented in FIG. 4 by horizontal support members 30 and as shown in FIG. 10 by way of example. Each of the eight dipoles 31 thru 38 is tilted the same angle $\psi_1$ and in the same direction relative to the plane 39 to achieve circular polarization. This tilt angle $\psi_1$ may be for example about 36° from the plane 39. The eight dipoles are fed with equal amplitude currents via an eight-way power divider 41 and respective feed lines 42, 43, 44, 45, 46, 47, 48 and 49, illustrated in FIG. 4. The feed lines 42 thru 49 are for example coaxial lines as described previously in connection with FIG. 2. The eight dipoles 31 thru 38 are fed in progressive quadrature phasing. That is, the adjacent dipoles are fed 90° out-of-phase. Thus, there are two complete cycles (Mode H=2) of phase progression around the mast 40. The lines 42 thru 49 can have phase shifting means such as extra length lines to achieve the relative phase shifts as discussed previously in connection with FIG. 2. The eight-element ring of radiators 31 thru 38 may be considered as two superimposed sub-rings of four alternate elements. The elements of each sub-ring have 180° phasing. Thus, there can be no mast re-radiation of the vertically polarized wave components from either sub-ring. Also, there is little or no coupling of the vertically polarized wave components to the horizontal, dipole support members 30, since the members lie in a neutral plane relative to the vertical components.

Figure 5:
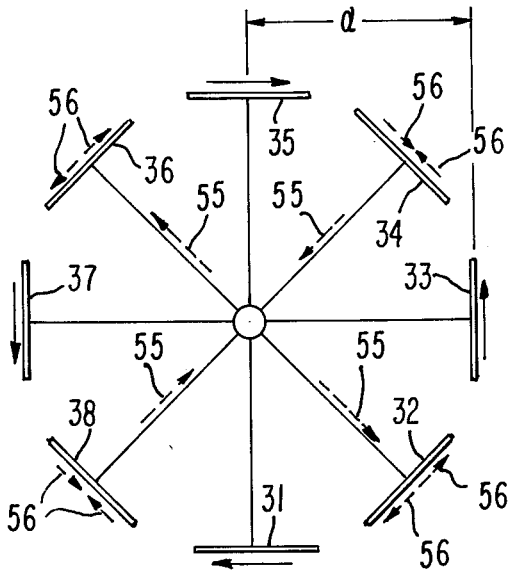
FIG. 5 is a sketch illustrating the horizontal polarization components in the system of FIGS. 3 and 4.

FIG. 5 is a sketch of the horizontal polarized wave components in the system of FIGS. 3 and 4. Considering only the horizontal wave components, there are no mast currents since the mast is orthogonal to the horizontal wave components. Considering the currents in the horizontal dipole supports or spacers, the currents in the sub-ring radiators 31, 33, 35 and 37 do not excite any appreciable net current in their horizontal dipole support members since the radiators are orthogonal to their own and to the oppositely extending support members. Further, for each radiator the diametrically opposite radiator current is in the opposite direction. Since the currents from radiators 31 and 35 flow in opposite directions, there is little or no net induced current from radiators 31 and 35 on the horizontal support members of radiators 33 and 37. Similarly, the horizontal support members for radiators 31 and 35 have little or no net induced current from radiators 33 and 37. The same reasoning discussed above relative to the sub-ring of radiators 31, 33, 35 and 37 applies to the sub-ring of radiators 32, 34, 36 and 38.

Currents in one of the two sub-rings of radiators depicted in FIG. 5 can induce currents in the other sub-ring. Currents in the sub-ring of radiators 31, 33, 35 and 37, for example, can cause current flow in the support members of the sub-ring radiators 32, 34, 36 and 38. However, as shown in FIG. 5, these currents on the support members are cancelling. The currents induced along the oppositely extending support members are in opposite directions (see dashed arrows 55), and hence re-radiation is minimized. Currents in the sub-ring of radiators 31, 33, 35 and 37 can cause current flow in the radiators 32, 34, 36 and 38. The dashed arrows 56 illustrate the currents in the dipole radiators 32, 34, 36 and 38 due to excitation of radiators 31, 33, 35 and 37. The induced currents on radiator 32, for example, from radiator 31 is in an opposite direction to the induced current from radiator 33. Similar cancelling is provided at radiator 34, 36 and 38. The same condition exists with respect to currents in dipole radiators 31, 33, 35 and 37 due to excitation of radiators 32, 34, 36 and 38. Since the induced currents are cancelling, there is low radiation resistance and, therefore, there is reduced effect on patterns. Re-radiation effects of both the mast and horizontal dipole support members are reduced to zero or minimized.

Figure 6:
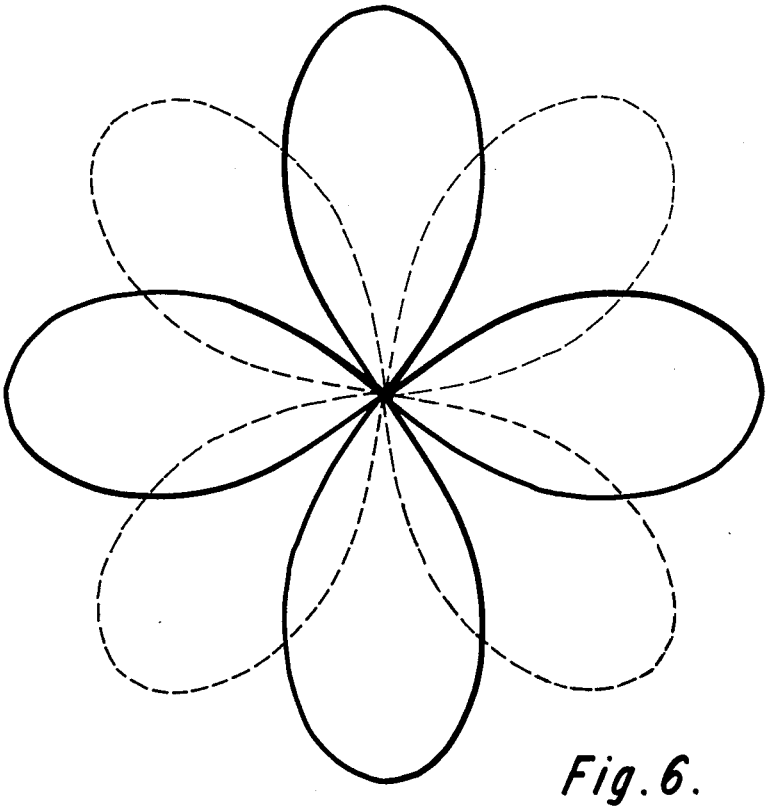
FIG. 6 illustrates the azimuth patterns for the system illustrated in FIGS. 3 and 4.
Figure 7:
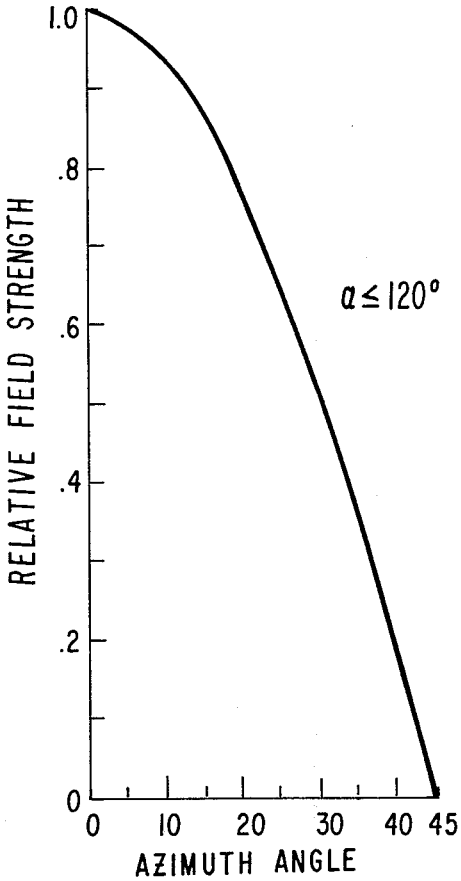
FIG. 7 illustrates the repetitive relative field strength versus azimuth angle for both horizontal and vertical polarization for a system as shown in FIGS. 3 and 4.
Figure 8:
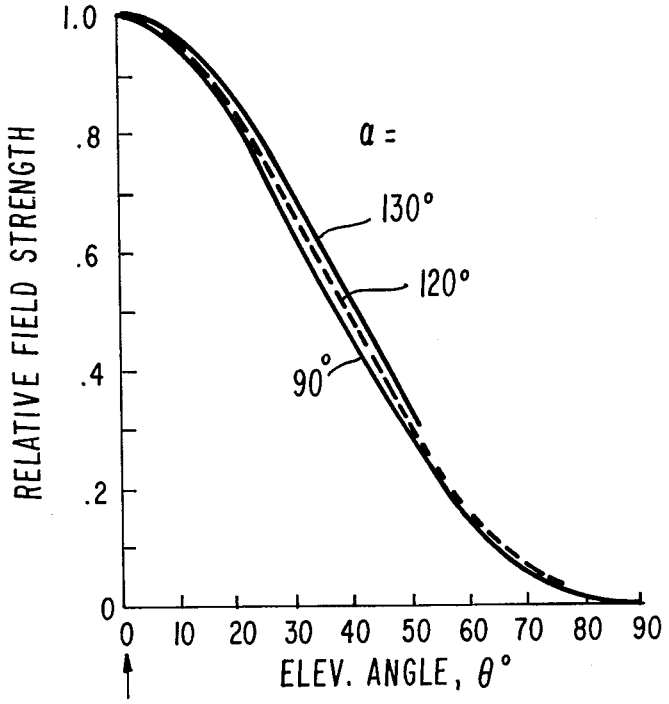
FIG. 8 illustrates the relative field strength versus elevation angle of the vertically-polarized components for a system as shown in FIGS. 3 and 4.
Figure 9:
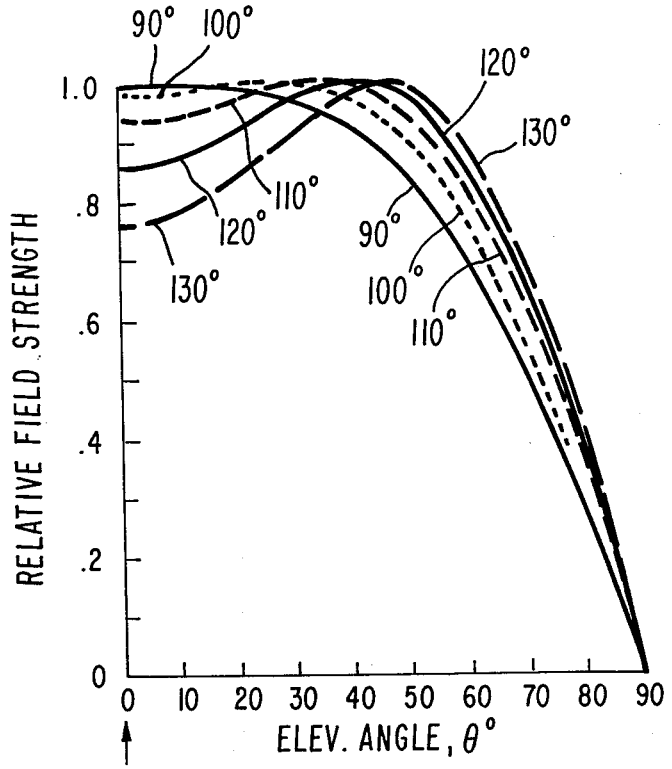
FIG. 9 illustrates the relative field strength versus elevation angle of the horizontally-polarized components for a system as shown in FIGS. 3 and 4.

FIG. 6 shows the azimuth patterns of the radiators 31, 33, 35 and 37 in solid lines and the radiators 32, 34, 36 and 38 in dash lines. A resulting circular azimuth pattern is obtained with the elements fed as illustrated in FIG. 4. The pattern, as illustrated, holds true for both the horizontal and vertical polarization. There is no coupling between the radiators 31, 33, 35, and 37, and the radiators 32, 34, 36 and 38 since one lies in the neutral plane of the other. FIG. 7 shows relative field strength versus azimuth angle for both horizontal and vertical polarization for each tilted dipole as computed for a radius ($\alpha$ in FIG. 5) up to one-third wavelength or 120°. FIG. 8 shows the computed elevation pattern shape of the vertically polarized components for a system like that shown in FIGS. 3 and 4, and shows that the pattern shape is relatively independent of the ring radius $\alpha$. Referring to FIG. 9, there is illustrated the elevation pattern of the horizontally polarized component for a system like that shown in FIGS. 3 and 4. FIG. 9 shows that the beam-width is generally greater and that a dimple develops at $\theta = 0°$ (broadside direction) as the radius $\alpha$. increases from one-quarter wavelength. The relative gains between the vertical and horizontal components are easily adjusted by merely changing the tilt angle of the dipole relative to the horizontal plane. To increase gain in the horizontal direction, additional layers of dipole arrays as shown in FIGS. 3 and 4 are stacked one above the other with their center of radiation spaced about a wavelength apart.

A circularly-polarized antenna system according to the present invention was built and tested. This antenna system operated with an axial ratio of 3 d.b. or less over the frequency band from 460 to 590 MHz and is similar to that illustrated in FIGS. 3 and 4. The antenna system includes eight dipoles each tilted in the same direction at an angle of 36° with respect to the common plane of the dipoles, with the dipoles fed in the H = 2 mode as illustrated in FIGS. 3 and 4. FIG. 10 is a sketch of one of the dipoles 51 spaced from the mast 50. The mast 50 in this case is 1 inch in diameter. A collar 53, 1 ¾ inches in diameter, is secured about the mast. The tilted dipole 51 is spaced from the mast and fed by a balun 65. The balun includes a pair of parallel conductive pipes 66 and 57 fixed to the collar 53 and spaced one above the other. The pipes 66 and 57 extend a length of 5.5 inches from the collar to the halves 51*a* and 51*b* of dipole 51. The conductive pipes 66 and 57 have a diameter of 0.219 inches and are spaced 0.219 inches from each other to form a characteristic impedance line of 150 ohms. The one dipole half 51*a* is connected to the upper pipe 66 while the other dipole half 51*b* is connected to the lower pipe 57. The dipole halves have a length L from 4.6 to 4.8 inches. A coaxial line is formed by the upper conductive pipe 66, with an inner conductor 59 being insulated from and passing through the upper pipe 66. The inner conductor 59 is coupled to the lower dipole element 51*b* at the dipole end of the lower pipe 57. The other seven dipoles are similarly arranged and dimensioned. The eight dipole elements are phased (Mode H=2) with the adjacent elements at quadrature as described in connection with FIG. 4.

While the above description discusses tilted dipoles fed in Mode 1 with four dipoles and in Mode 2 with eight dipoles, it is readily apparent that many other configurations are achievable within the scope of the present invention. It is also to be understood that the term "circularly-polarized" refers to those antennas where the axial ratio is relatively low on the order of 3 d.b. or less. It is also understood that the mast size is made sufficiently large to support the dipoles. Adjustments such as alteration of the tilt angle of the dipoles and the spacing of the dipoles from the mast can be made to adjust for mast sizes.

What is claimed is:

1. An omnidirectional circular polarization antenna system comprising:

a plurality of dipoles equally spaced from one another about a conductive support mast with the dipoles equally spaced from the mast with their centers lying on a circle in a plane orthogonal to said mast, each of said dipoles having dipole halves with the one dipole half extending above and the other dipole half extending below said plane and the dipole halves being tilted at the same acute angle with respect to said plane, means for exciting said dipoles in rotating phase where the mode number equal to the number of 360° phase changes about the ring of said dipoles is an integer other than zero, said tilt angle being determined to radiate from said antenna system circularly polarized waves omnidirectionally broadside said mast.

2. The combination of claim 1 wherein said plurality of dipoles is four and the mode number is 1.

3. The combination claimed in claim 1 wherein said dipoles are tilted with respect to said plane at an angle of about 36°.

4. The combination claimed in claim 1 wherein the number of dipoles is eight and the mode number is 2.

5. The combination claimed in claim 4 wherein said dipoles are tilted with respect to said plane at an angle of about 36°.

* * * * *